US008636389B2

(12) United States Patent
Knappschneider

(10) Patent No.: US 8,636,389 B2
(45) Date of Patent: Jan. 28, 2014

(54) PROJECTION STREET LAMP

(76) Inventor: Uwe Knappschneider, Wuppertal (DE)

( * ) Notice: Subject to any disclaimer, the term of this patent is extended or adjusted under 35 U.S.C. 154(b) by 0 days.

(21) Appl. No.: 13/635,161

(22) PCT Filed: Mar. 16, 2011

(86) PCT No.: PCT/EP2011/001301

§ 371 (c)(1),
(2), (4) Date: Nov. 29, 2012

(87) PCT Pub. No.: WO2011/113589

PCT Pub. Date: Sep. 22, 2011

(65) Prior Publication Data

US 2013/0063947 A1 Mar. 14, 2013

(30) Foreign Application Priority Data

Mar. 17, 2010 (DE) ..... 20 2010 003 778 U

(51) Int. Cl.
*F21S 8/00* (2006.01)

(52) U.S. Cl.
USPC ..... 362/431; 362/277

(58) Field of Classification Search
USPC ..... 362/431, 277
See application file for complete search history.

(56) References Cited

U.S. PATENT DOCUMENTS

| | | | | | |
|---|---|---|---|---|---|
| 4,999,749 | A * | 3/1991 | Dormand | 362/153.1 |
| 5,072,345 | A * | 12/1991 | Goggia | 362/153.1 |
| 5,134,550 | A * | 7/1992 | Young | 362/560 |
| 5,575,550 | A | 11/1996 | Appeldorn et al. | |
| 6,183,112 | B1 * | 2/2001 | Bomas | 362/285 |
| 7,976,199 | B2 * | 7/2011 | Berns et al. | 362/298 |
| 2008/0285265 | A1 | 11/2008 | Boissevain | |

FOREIGN PATENT DOCUMENTS

| | | |
|---|---|---|
| AU | 603 757 B3 | 9/1990 |
| DE | 90 13 023 U1 | 11/1990 |
| DE | 196 16 461 A1 | 11/1996 |
| DE | 693 12 323 T2 | 2/1998 |
| FR | 26 83 618 A1 | 5/1993 |

* cited by examiner

*Primary Examiner* — Mary Ellen Bowman

(57) ABSTRACT

A street lamp having a tubular pole element has a projection device (6) light source (35) that is built into the pole element (4). With an optical focusing device (36) in the mast element (4), the rays of the light source are projected onto an optical deflecting mirror (20) via a focusing device (36), deflecting the light rays can be deflected through a light exit opening (5) of the pole element (4) onto a remote projection surface. A motif carrier (48) is provided in the ray path between the light source (35) and the deflecting mirror (20). The motif carrier accommodates a motif (49) to be depicted on the projection surface. An adjustable projection lens (57, 58) is arranged between the motif carrier (48) and the deflecting mirror (20), by means of which at least the sharpness of the motif (49) depicted on the projection surface can be adjusted.

15 Claims, 4 Drawing Sheets

PROJECTION STREET LAMP

CROSS REFERENCE TO RELATED APPLICATIONS

This application is a United States National Phase application of International Application PCT/EP2011/001301 and claims the benefit of priority under 35 U.S.C. §119 of German Utility Model DE 20 2010 003 778.6 filed Mar. 17, 2010, the entire contents of which are incorporated herein by reference.

FIELD OF THE INVENTION

The present invention pertains to a street light having a tubular pole element.

BACKGROUND OF THE INVENTION

In the present case, a street light is defined as an illumination device, by means of which pathways, public spaces, courtyard entrances and the like can be illuminated more in the outdoor area. This includes, for example, pole lights or even so-called "light bollards" designed as being shorter in their height. Such street lights all have at least one pole element. As is well known from the state of the art, such pole elements usually have a tubular design, and they have a cavity for accommodating cabling, an electronic control unit and/or even a power circuit. The tube cross section here may have a different design, e.g., rectangular, square or circular, to name only a few examples.

Furthermore, it is known that for the installation of electric energy supply, such pole elements have closable inspection openings in the bottom area, such that the electrical installation is accessible if necessary. Such street lights usually have in their upper end area an illumination device, by means of which the surrounding area of the street light can be illuminated. In the meantime, illumination systems have also become known, in which further light means, for example, for the floodlighting of buildings or the like can be provided in a middle area on the light pole.

For optimal illumination of public spaces, company premises and the like, usually a plurality of such street lights are set up and aligned with their lighting means corresponding to the area to be illuminated. Furthermore, further lighting means may be provided on the light pole, by means of which, for example, the facade of a building can be floodlighted.

Recently, the requirements especially on the manner of illumination or floodlighting of buildings or other projection surfaces have increased.

SUMMARY OF THE INVENTION

Accordingly, a basic object of the present invention is to design a street light of this type, such that additional illumination effects, especially of house walls, but also of floor or ceiling areas are possible in a simple manner.

This object is accomplished according to the present invention by a projection device having a light source being built into the pole element, whose light rays can be projected onto an optical deflecting mirror by means of an optical focusing device in the pole element, by means of which the light rays can be deflected onto a remote projection surface through a light exit opening of the pole element, and by a motif carrier, which accommodates a motif to be depicted on the projection surface, being provided in the ray path between the light source and the deflecting mirror, and by an adjustable projection lens, by means of which the sharpness of the motif depicted on the projection surface is adjustable, being arranged between motif carrier and deflecting mirror.

An illumination device, by means of which especially spaces with public access, but also company premises and the like can be illuminated in a variably optically responsive manner is provided by the design of the street light according to the present invention. A street light is especially provided by the design according to the present invention, which makes it possible to project different motifs on a house wall or in predetermined areas of the surrounding area of the street light. Here, it is not necessary to install a separate projection device. The further advantage of the integration of the projection device into the street light is that no special safety measures have to be taken both for the operation and against theft, since the projection device is an integral component of the street light.

Thus, provisions may be made that the light source and focusing device form one unit together with the motif carrier, and that the light source, focusing device and motif carrier are designed as adjustable in relation to one another in the direction of the light rays. By means of this embodiment, especially the light optics can be adapted in a simple manner to the result of the motif to be projected onto a projection surface to be achieved. The light source together with the focusing device as well as the motif carrier can, furthermore, be arranged integrated as one unit in the pole element, such that this can be installed in a simple manner.

Furthermore, provisions may be made for the light source to be accommodated replaceably in a lamp socket, and for the lamp socket to be mounted via a plate-shaped lamp socket holder in an adjustable and fixable manner along a guide system, especially two guide rods, and for the motif carrier to have a plate-shaped design and be fastened in an adjustable and fixable manner to the same guide system, especially to the same guide rods. Instead of such guide rods, other guide elements or fastening elements are also conceivable. Thus, for example, a U section or even an L section arranged on one side may also be provided for the adjustable accommodation of individual components. An extremely simple and easy to manage structure of the light source together with the lamp socket holder as well as the motif carrier is achieved by this embodiment.

Furthermore, provisions may be made for the focusing device to be designed as a rotationally symmetrical, ellipsoidal reflector, as a cold light reflector or as a beveled reflector, each of which has an elliptical geometry. A simple focusing and projection of the light ray onto the deflecting mirror is achieved by this (these) embodiment(s). Since the focusing device is arranged in an adjustable manner at the guide rods or even a U or L section, an optimal projection of the light ray under the use conditions present in each case may thus also be achieved.

In case an ellipsoidal reflector is provided, an additional ring reflector may be assigned to this, by means of which both the efficiency and the brightness distribution of the light source can be optimized.

Further, provisions may be made for the focusing device to be formed from a combination of an adjustable spherical mirror arranged behind the light source and an adjustable twin condenser with two nonspherical lenses arranged in front of the light source. This embodiment is especially advantageous for a parallel light focusing of the light rays exiting from the light source.

Furthermore, provisions can be made for the projection lens to be designed as a replaceable projection lens with high image quality and especially as a triplet lens and to form an optical unit together with the deflecting mirror, and for the lens and the deflecting mirror each to be fastened in an adjustable manner via a carrier element to a guide system, especially two guide rods. By means of this embodiment, the deflecting mirror thus forms together with the lens a structural unit, which can be arranged integrated as a whole in the pole element. A relative adjustment of lens to deflecting mirror can also be carried out in a simple manner especially by means of the two guide rods provided. Moreover, the lens may also be adjusted correspondingly in relation to the motif carrier as well as to the light means, such that a sharpness projection of the motif on the projection surface can be adjusted in the simplest manner. Also, the guide system, as already mentioned above, may consist of guide elements other than the guide rods claimed in the examples. Aside from the above-mentioned U or L sections, so-called "dovetail guides" or the like could also be used here.

As an alternative to the embodiment, provisions may be made for the lens to be formed from two planoconvex lenses adjustable in relation to one another and for the planoconvex lenses each to be fastened in an adjustable manner to two guide rods via a plate-shaped lens holder together with the carrier element of the deflecting mirror. By providing especially two planoconvex lenses, the structure of a simple lens, which can be produced in a cost-effective manner, is achieved. By using two planoconvex lenses, a zoom effect and an optimized sharpness adjustment are also possible because of the axial adjustability in relation to one another in a simple manner. Instead of the planoconvex lenses, one or more biconvex lenses may also be used.

Further, provisions may be made for a device carrier, which can be selectively and replaceably equipped with color filters and/or adjustable masking apertures, to be provided between the focusing device and the motif carrier. Further photo-optical effects on the projection surface can be adjusted by means of this embodiment.

Provisions may also be made for the deflecting mirror to be accommodated in a mounting bracket, pivotable about a bearing axis running transversely to the pole element. By means of this pivotable mounting of the deflecting mirror, a vertical adjustment of the projection device is possible, such that, for example, at a preset location of the street light and especially at a preset light exit height, the projection device can be adapted to a present projection surface, such as, for example, a house wall. Furthermore, a corresponding illumination effect on the background may also be achieved in the surrounding area of the street light by the deflecting mirror being adjusted in such a way that the light rays strike in the surrounding area of the street light, and thus, the selected motif is projected onto the background.

At this point it should be noted that the projection device can be arranged with its deflecting mirror both in a "standing" and in a "hanging" position in the pole light or in the pole element. For a standing position, the light exit is adjustable in the horizontal direction slightly upwards up to the background, while in a hanging arrangement a ceiling illumination or the like, for example, is also achievable.

Further, provisions may be made for all components of the projection device to form one unit and to be connected via a guide system, and especially two guide rods, and for all components of the projection device to be designed as adjustable in relation to one another. By means of this embodiment, the complete projection device may be inserted as a uniform structural unit into a pole element and fixed there. Thus, a simple retrofit of a street light could also be carried out, whereby, for this purpose, the pole element is to be provided beforehand with a corresponding light exit and, if necessary, with an inspection opening on the rear side for inserting the projection device as well.

Further, provisions may be made for the displacement and adjustment of each displaceable and/or adjustable component of the projection device to be carried out by means of a servomotor each, and for the servomotors to be remote controllable. By means of this embodiment, especially the direction of projection as well as sharpness adjustment or even size adjustment of the projection surface can be changed in a variable manner.

Further, provisions may be made for the pole element accommodating the projection device to be designed as a separate component and selectively to be insertable into a split light pole or attachable to the light pole, and for the pole element to be designed as adjustable over 360° about the longitudinal axis of the light pole in relation to the light pole with regard to the horizontal direction of beam of the projection device. By means of this embodiment, the projection device can be adapted, as desired, to the use conditions. The direction of projection can especially be changed by means of this embodiment even after installation.

For an easy accessibility for the purpose of maintenance or repair, provisions may, furthermore, be made for the pole element to have a closable inspection opening on its side opposite the light exit opening.

Further, provisions may be made for the inside diameter of the pole element to be selected, so that there is a greater annular clearance between the projection device (between the pole element and projection device), so that a circumferential convective flow of air is brought about within the pole element during operation due to the development of heat of the light source. By means of this embodiment, a cooling effect of the light source is achieved, such that a cooling fan or the like can be completely dispensed with—even in case of greater light output of the light source.

The present invention is explained in detail by means of examples based on the drawing. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
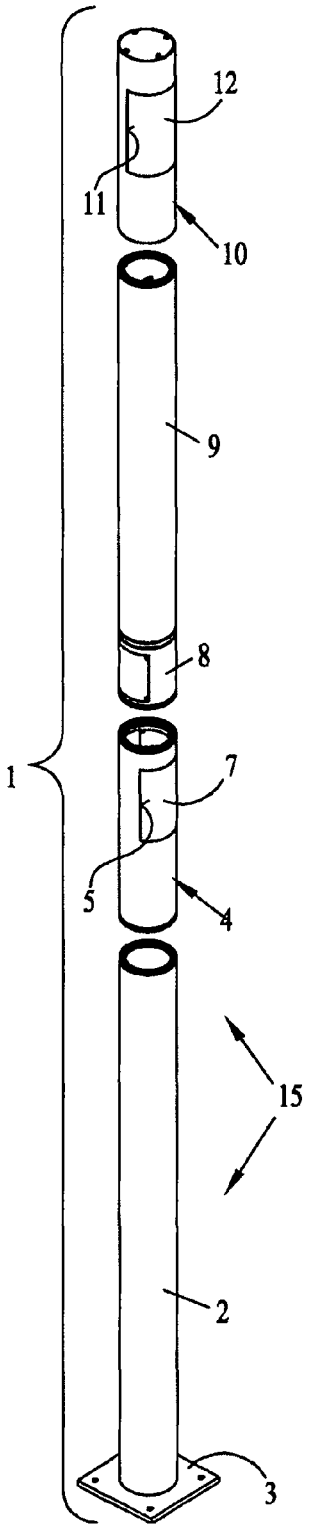
FIG. 1 is perspective view of a street light having a light pole designed as being multiply split as well as a pole element designed as a separate component, which accommodates a projection device.

Referring to the drawings in particular, FIG. 1 shows a perspective exploded view of a possible embodiment variant of a light pole 1, which has a multicomponent design in the embodiment shown.

Thus, the light pole 1 in the exemplary embodiment shown consists of a lower basic element 2, which is provided for anchoring the bottom in its lower end area with a flange plate 3. Instead of such a flange plate 3, the basic element 2, extended downwards, may also be provided with a mounting tube anchorable in the background (not shown in the drawing).

In the present exemplary embodiment, above the basic element 2 is provided a pole element 4, which is provided in the area of its upper half with a light exit opening 5. This light exit opening 5 can be closed tightly with a corresponding, for example, attached glass pane 7. As is obvious from FIG. 2, in the present exemplary embodiment, this pole element 4 is used for accommodating a projection device 6. Further, the glass pane 7 is likewise obvious from FIG. 2. On the rear side, the pole element is furthermore provided with a closable inspection opening 13, by means of which the projection device 6 is accessible for installation as well as for repair or adjustment. In this case, the inspection opening 13, as shown as an example in FIG. 2, may extend over the entire height of the projection device 6.

Furthermore, the light pole 1 may also have other intermediate elements 8 and 9 as well as an upper final element 10. In the present exemplary embodiment, the upper final element 10 is also provided with a light exit opening 11, which is also tightly covered by a glass pane 12. Because of the design of this light exit opening 11 in the upper end area of the light pole 1, an asymmetrical illumination of the surrounding area of the light pole 1 can thus be achieved through the light exit opening 11. In the embodiment variant shown as an example, the light pole 1 forms, with its upper final element 10, a complete street lamp, which is shown as a whole by reference number 15 and in the mounted state in FIG. 3.

Figure 2:
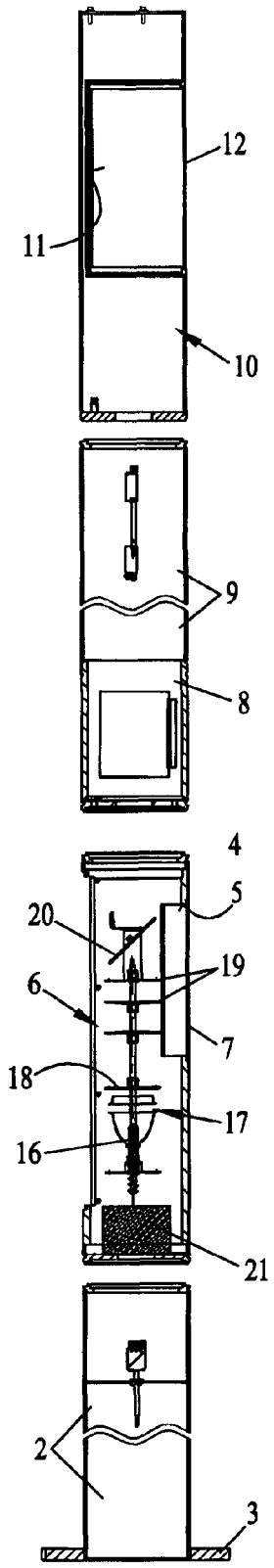
FIG. 2 is an axially shortened sectional view of the light pole from FIG. 1 with integrated projection device.

As is obvious from FIG. 2, the projection device 6 has, in the lower end area, a lighting means 16 together with a focusing device 17 and a motif carrier 18 in the "standing" vertical orientation shown. In the exemplary embodiment shown, a two-component projection lens, by means of which the light stream beamed from the lighting means 16 and the focusing device 17 is projected onto a deflecting mirror 20, is provided above the motif carrier 18. It can also be seen that the pole element 4 accommodates an electric and/or electronic control unit 21 under the projection device 6, which is especially used for controlling the light source 16 but also for any other motor drives provided (not shown in the drawing) of the projection device.

Figure 3:
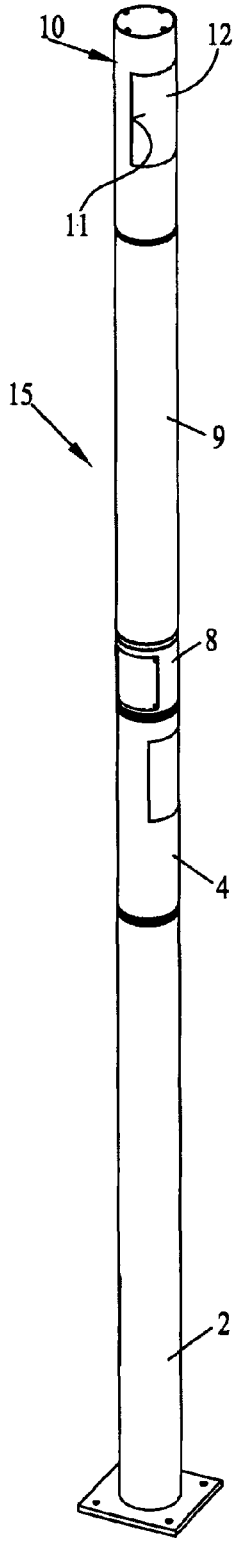
FIG. 3 is perspective view of the light pole from FIG. 1 in the assembled state.

FIG. 3 shows the mounted state of the street lamp 15 with its individual components such as basic element 2, pole element 4 as well as the two intermediate elements 8 and 9 and upper final element 10. It can be seen that, in the exemplary embodiment shown, the entire street lamp 15 has a continuous cylindrical structure over its entire height. It should be noted here that the upper final element 10 may also be designed in a different manner. For example, the light exit opening 11 could also have a completely circumferential design and be formed by a circumferential glass body. Other illumination elements could also be adapted in the upper end area of the light pole 1, for example, in the form of a boom with light housing or the like.

Figure 4:
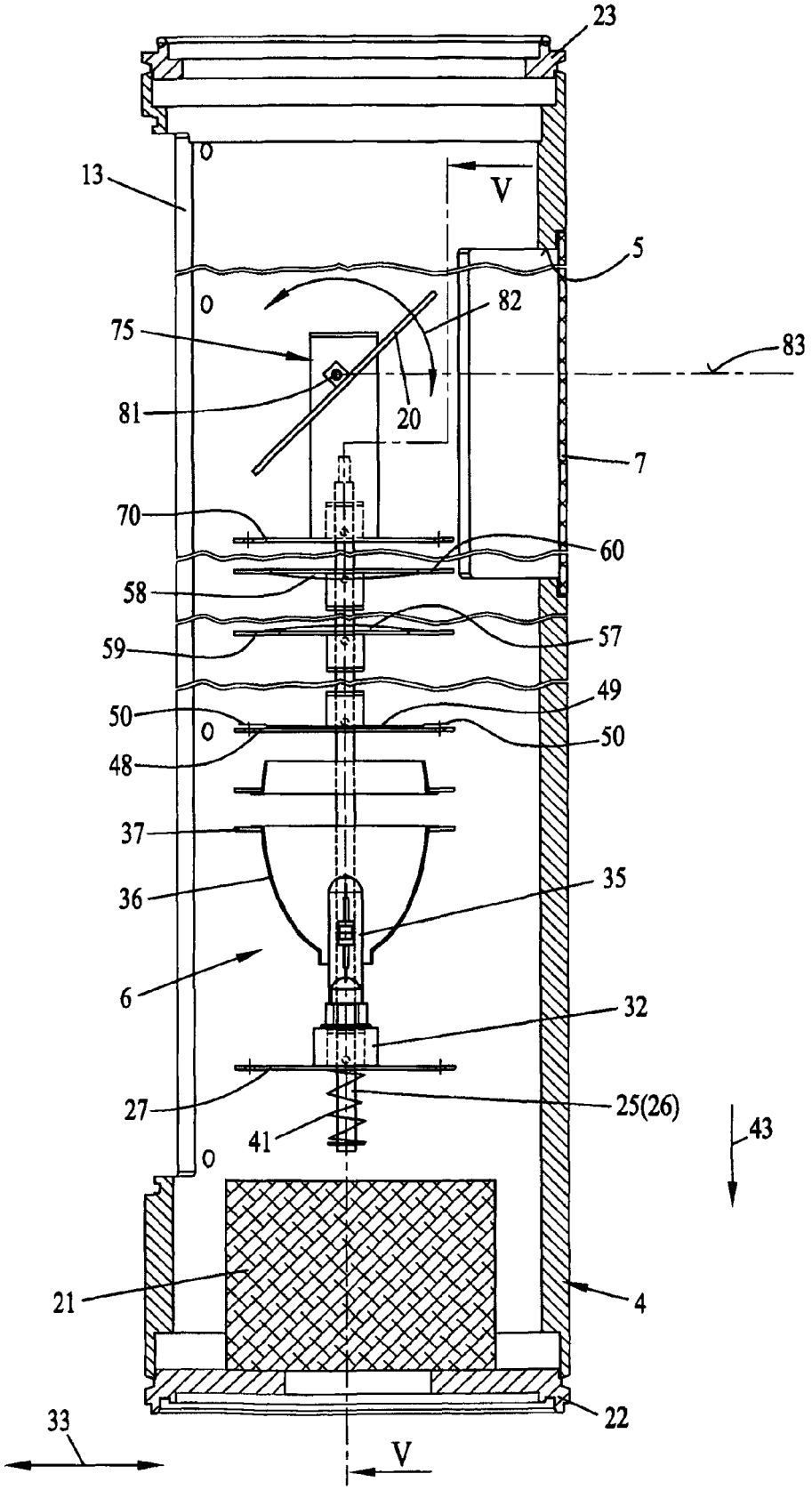
FIG. 4 is a schematic diagram of a projection device according to present invention in a sectional view in its installed state in the pole element from FIG. 2.
Figure 5:
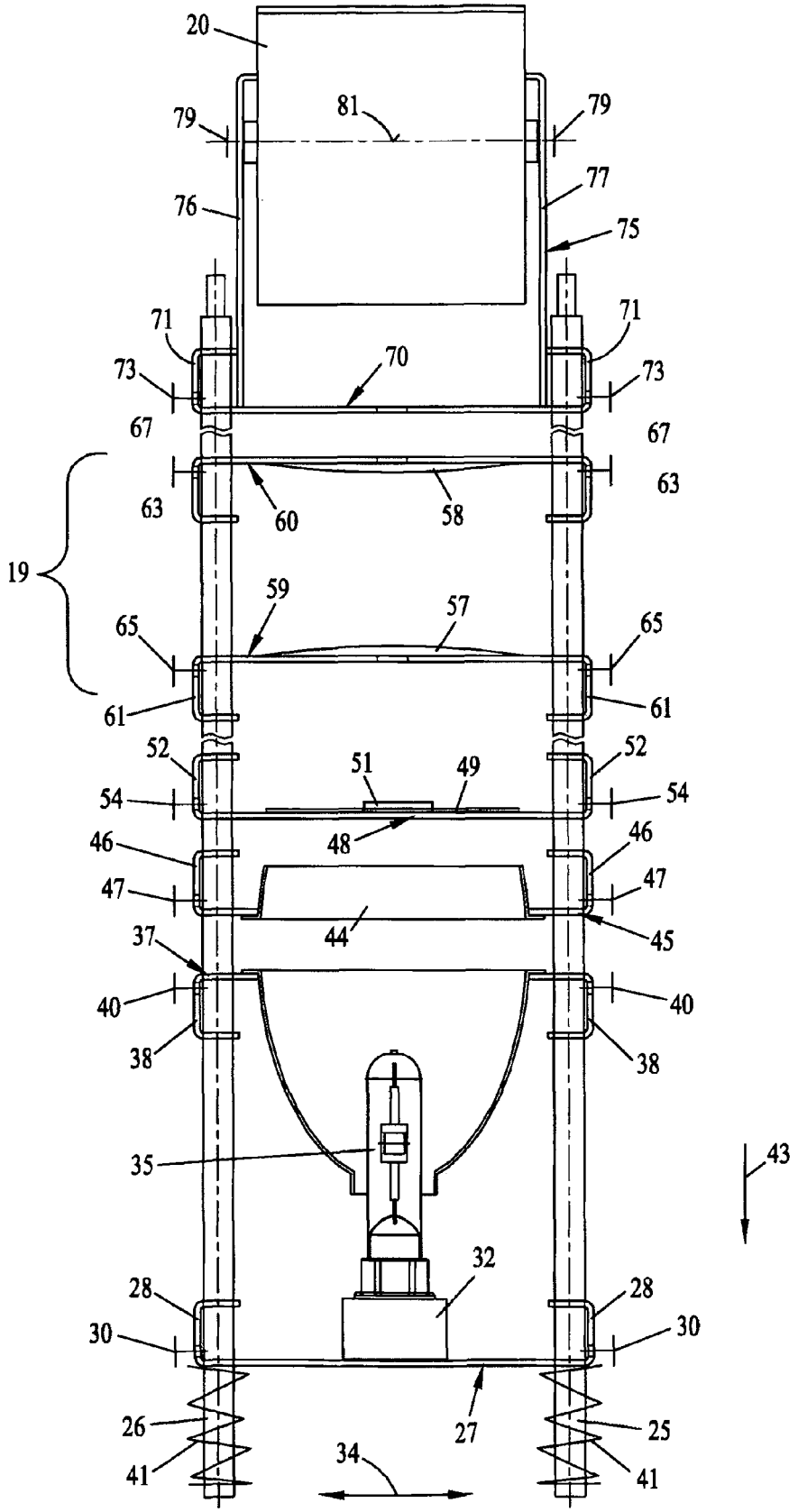
FIG. 5 is a view V of the projection device from FIG. 4 without the pole element surrounding the projection device in FIG. 4.

FIG. 4 shows a sectional view of the projection device 6 together with the pole element 4 from FIG. 2. Furthermore, FIG. 5 shows another sectional view V-V from FIG. 4, but without the surrounding pole element 4. In principle, the structure of the projection device 6 and in FIG. 4 also the principle arrangement of the projection device 6 in the pole element 4 can be seen from these two views, in which the overall height of the projection device 6 as well as of pole element 4 (FIG. 4) is shown as shortened.

Thus, the projection device in the present exemplary embodiment has two guide rods 25 and 26, to which the individual components of the projection device 6 are preferably fastened in an adjustable and fixable manner. The light exit opening 5 with its glass pane 7 as well as the inspection opening 13 essentially diametrically opposite the light exit opening 5 can be seen from FIG. 4, especially in an enlarged view. For the sake of clarity, a closing cover for covering and securing the inspection opening 13 is not shown. However, the design and mounting of such a closing cover are sufficiently known from the state of the art, such that this will not be dealt with in detail here.

It can also be seen from FIG. 4 that the electric and/or electronic control means 21 is mounted in a fixed manner, for example, to a lower cover element 22 of the pole element 4. In the upper end area of the pole element is provided an annular coupling element 23, via which the pole element 4 can be coupled in a fixed manner with pole elements to be arranged above it, for example, in the form of the intermediate element 8 shown in FIG. 1. With regard to the cover element 22 and coupling element 23, other embodiments, which, for example, make possible a coupling of the pole element 4 with other pole elements, are also conceivable here.

As is further obvious from FIGS. 4 and 5, the projection device 6 has in the lower end area of the two guide rods 25 and 26 a plate-shaped lamp socket holder 27, which is guided in a longitudinally displaceable manner at the two guide rods 25 and 26 via two holding clamps 28 made integrally in one piece in a U-shaped manner in its outer areas. These holding clamps 28 are each provided with a locking screw 30, by means of which each adjusted position of the lamp socket holder 27 at the guide rods 25 and 26 can be determined. Instead of the holding clamps 28 shown as an example here, other fastening elements with identical action for the lamp socket holder 27 are conceivable as well. Thus, for example, block-type mounting elements with corresponding through holes may also be provided here. This also applies to the holding clamps described further below. Likewise, instead of the guide rods shown here as an example, a "guide housing" open on one side may, for example, also be provided, in which lamp socket holder 27 as well as the other components of the projection device 6 are accommodated in an adjustable manner. The guide rods 25, 26 may also be provided in a different number and/or with a different cross-sectional profile.

The lamp socket holder 27 accommodates on the top side a lamp socket 32, which can be oriented and fixed on the lamp socket holder 27 both in the direction of the double arrow 33 (FIG. 4) and in the direction of the double arrow 34 (FIG. 5) on the lamp socket holder 27. The lamp socket 32 accommodates a lamp 35 as a lighting means, which extends into an ellipsoidal reflector arranged above the lamp socket holder 27. This reflector 36 is likewise fixed to the two guide rods 25 and 26 in an adjustable and fixable manner via a reflector carrier 37 in its axial position opposite the lamp socket holder 27. Accordingly, the reflector carrier 37 likewise forms two U-shaped, offset holding clamps 38, which are likewise provided by means of a lock screw 40 each (FIG. 5) for fixing to the respective guide rod 25 or 26.

Furthermore, it is obvious from FIGS. 4 and 5 that an axial compression spring 41 is provided under the lamp socket holder 27 on the guide rods 25 and 26 each, against whose spring forces the lamp socket holder 27 can be adjustable vertically downwards in the direction of arrow 43, for example, for the purpose of replacing the lamp 35. Because of the adjustability of the lamp socket 32 in the direction of the two double arrows 33 and 34, the lamp 35 can be correspondingly aligned concentric to the reflector 36, so that the light rays, bundled, can beam vertically upwards and essentially running parallel to one another. A targeted "manipulation" of the brightness distribution is also made possible by the axial adjustability of the lamp socket 32 and its fixation in the desired position in relation to the reflector 36.

Basically, the position of the lamp 35 is adjustable, such that a greatest possible portion of the light stream falls into the projection lens 19 (FIG. 5) or 56 (FIG. 6) and optimally passes through the plane of the motif carrier 18 or 48.

It is also especially obvious from FIG. 5 that a ring reflector 44, which is fastened to guide rods 25 and 26 in an axially adjustable manner via a plate-shaped reflector holder 45, is provided above the reflector 36. This reflector holder 45 also has two U-shaped, offset holding clamps 46, via which the reflector holder 45 is guided to the two guide rods 25 and 26. These two holding clamps 46 are also provided with corresponding lock screws 47 for fixing the respective adjusted position, as this is obvious from FIG. 5.

Above the ring reflector 44 the projection device 6 has a plate-shaped motif carrier 48, on the top side of which a motif 49 can be placed. In the present exemplary embodiment, two clamp straps 50, by means of which the motif 49 is pressed against the top side of the motif carrier 48 and is thus fixed, are used for fixing the motif 49 on the motif carrier 48. For adjustable mounting at the guide rods 25 and 26, the motif carrier 48 also forms two holding clamps 52, which are also in turn provided with a lock screw 54 each for fixing the respective adjusted position.

The motif 49 may have different designs. Thus, for example, a company logo or an artistic molding shaped in another way by punching or milling or even by lasers can be provided here, which forms the actual object to be depicted on a projection surface. The motif can thus be replaced, as desired, on the motif carrier and can be irradiated by means of the light stream of the lamp 35 in conjunction with the focusing device consisting of the two reflectors 36 and 44.

For an optimal projection of this contour or this image, the projection lens 19 from FIG. 2, which, in the present exemplary embodiment according to FIGS. 4 and 5, consists of two planoconvex lenses 57 and 58 directed towards each other, is provided above the motif carrier 48. These planoconvex lenses 57 and 58 are each held at the guide rods 25 and 26 in an axially adjustable manner via a lens holder 59 and 60, respectively. For a corresponding precise guiding of these lens holders 59 and 60, each of these has two lateral, U-shaped, offset holding clamps 61 and 63. The holding clamps 61 and 63 are each provided with a lock screw 65 and 67, respectively, for fastening and fixing the respective adjusted axial position of the respective lens holder 59 and 60. By means of these two planoconvex lenses 57 and 58, a sharp image of the motif 49 on a corresponding projection surface is achieved by means of corresponding axial displacement and fixing.

Instead of planoconvex lenses 57 and 58 indicated as an example, the use of one or more biconvex lenses is also conceivable.

In the present exemplary embodiment according to FIGS. 4 and 5, a carrier plate 70, which is also provided with two lateral holding clamps 71, is located above this projection lens 19. With these holding clamps 71, the carrier plate 70 is mounted in an axially adjustable manner at the two guide rods 25 and 26. For fixing the respective selected axial position, these two holding clamps 71 are also each provided with a lock screw 73.

According to the present exemplary embodiment, a mounting bracket 75 with a U-shaped design is arranged in a fixed manner on the carrier plate 70. The deflecting mirror 20 from FIG. 2, which is pivotable via two lock screws 79 (FIG. 5) about a bearing axis 81 in the direction of double arrow 82 and can be fixed in its respective adjusting position by means of these lock screws 79, is provided between the two lateral walls 76 and 77 (FIG. 5) of the mounting bracket 75.

This deflecting mirror 20 makes it possible to adjust a projection with regard to its horizontal position, for example, on a house wall or a background corresponding to the desired appearance of the projected motif.

In the "standing" position of the projection device 6 shown in FIGS. 4 and 5, a projection from the horizontal 83 (FIG. 4) offset slightly upwards or even continuously up to the background is possible. If a projection shall be carried out, for example, on the ceiling of a room or of a hall, then the projection device (6) can also be rotated by 180°, so that the deflecting mirror 20 is arranged in the lower end area and thus a projection can be carried out in a variable manner in the upper area of a room or of a wall of a room.

Figure 6:
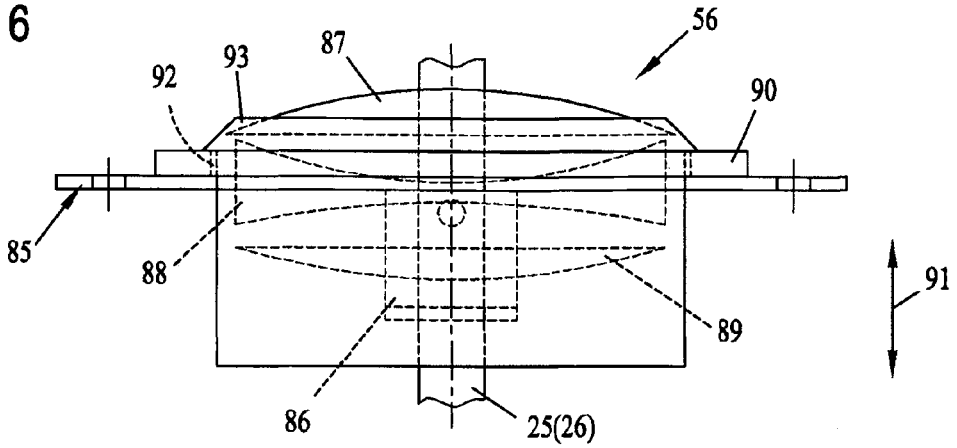
FIG. 6 is a view showing a second embodiment variant of a projection lens together with a deflecting mirror in a sectional view.
Figure 7:
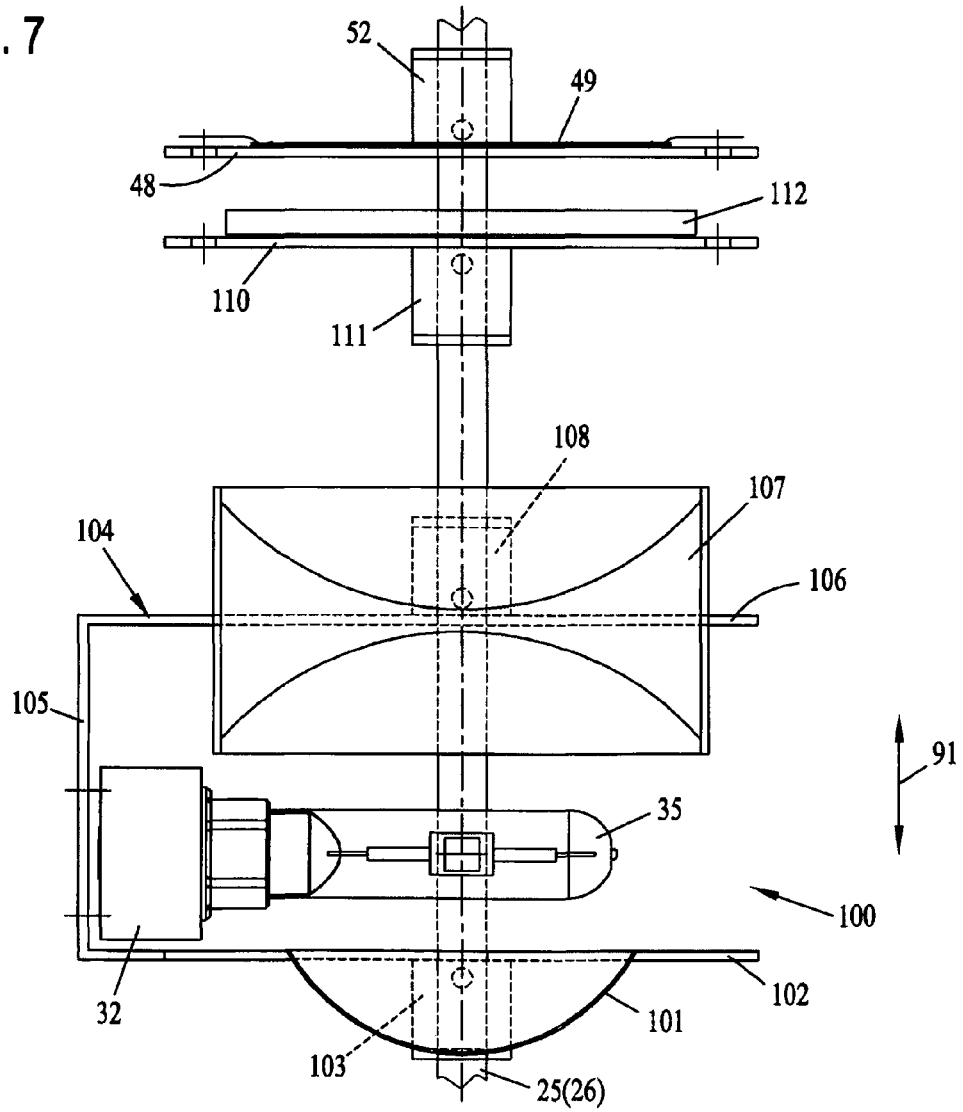
FIG. 7 is an enlarged sectional view of an embodiment variant of a light means together with a spherical mirror, a twin condenser as well as an additional device carrier together with the motif carrier.

The other drawing FIGS. 6 and 7 show sectional views of other embodiment variants, on the one hand, of the lighting means 35 together with a focusing device as well as, on the other hand, of a special embodiment of a projection lens 56.

FIG. 6 shows another embodiment variant of a projection lens 56, which can be used as an alternative to the projection lens 19 from the previous drawing figures. This projection lens 56 is a so-called triplet lens, which is accommodated in an adjustable manner at the two guide rods 25, 26 via a corresponding lens holder 85. Such a triplet lens 56 is characterized by a very high image quality (low number of errors, resolution). Instead of using such a "three-lens" projection lens in a "triplet method of construction," simpler one- or two-lens methods of construction of suitable focal length and image quality can be used. The fastening to these guide rods 25 and 26 is identical to the fastening of the two lens holders 59 and 60, for example, from FIG. 5. Accordingly, the lens holder 85 also has two holding clamps 86 of a U-shaped design, of which only the "rear" one can be seen in dotted lines in FIG. 6.

In the present exemplary embodiment, this triplet lens 56 has three lenses 87, 88 and 89, lying one behind the other, which are adjusted to different focal length in combination with one another. A focal length range of F=180 mm to F=350 mm is provided according to the present invention. This triplet lens 56 is held in the lens holder 85 via a mounting plate 90 and is thus also moved in the axial displacement in the direction of double arrow 91 of the lens holder 85. By means of this displacement, a "coarse adjustment" of the sharpness of the motif to be projected is adjustable. The triplet lens 56 is, furthermore, held in the mounting plate 90 via a threaded connection 92, such that by rotating an outer adjusting ring 93, a fine adjustment is made possible for adjusting the sharpness of the motif to be projected onto the projection surface in the direction of arrow 91.

Instead of this triplet lens 56 with fixed focal length, a "zoom lens" may also be used, such that the size of the image of a motif to be projected on a projection surface is additionally adjustable.

FIG. 7 shows another embodiment variant of a focusing device 100, which, in the exemplary embodiment shown, consists of a lower spherical mirror 101, lying "behind" the lighting means in the form of a lamp 35. This spherical mirror 101 is accommodated in a plate-shaped mirror holder 102, which is likewise accommodated in an axially adjustable manner via two holding clamps 103 along the guide rods 25 and 26. Of the two holding clamps 103, the "rear" holding clamp 103 can also be seen in FIG. 7 in dotted lines.

In the exemplary embodiment shown, the mirror holder 102 is a component of a holding frame 104, which has on the left side a vertically running mounting plate 105 and on the top side a condenser holder 106 with a plate-shaped design. In the area of the mounting plate, the lamp 35 is fastened to the mounting plate 105 via the lamp socket 32 running transversely to the direction of adjusting of double arrow 91. As already described regarding FIGS. 4 and 5, a displacement possibility or an adjustment possibility of the lamp in relation to the spherical mirror 101 is also provided here.

Condenser holder 106 is used to accommodate a twin condenser 107, whereby for fixing condenser holder 106, this is likewise provided here with two holding clamps 108 and corresponding lock screws (not visible in the drawing). In the present exemplary embodiment, this twin condenser 107 has two nonspherical lenses (not described in detail) with improved image quality for use with optical color changers as well as for a more uniform brightness distribution. Thus, the focusing device 100, consisting of the spherical mirror 101 as well as the twin condenser 107, and the lamp 35—because of the displaceable or adjustable arrangement of the lamp 35 with its lamp socket 32—can be aligned against one another such that a parallel, as homogeneous as possible light beam can be radiated vertically upwards to the motif carrier 48 with its motif 49 likewise provided in FIG. 7. One of the holding clamps 52 of the motif carrier 48 can likewise be seen in FIG. 7.

In the exemplary embodiment shown in FIG. 7, another additional "device carrier" 110 is provided, which is likewise arranged in an adjustable manner at the two guide rods 25 and 26 by means of two holding clamps 111 in the direction of double arrow 91. This device carrier 110 is used for the accommodation of other optical components, for example, dichroic color filters, an optical color-mixing unit with CMY or CMYK graduated filter or dimming device. A motorized digital multiplex control (DMX) may also be provided for this. In the exemplary embodiment shown, an adjustable masking aperture 112 is provided, which is only shown schematically in FIG. 7. Further optical effects can be achieved on the projection surface by means of these additional optical components.

Furthermore, it should also be noted at this point that the overall construction is designed such that no additional ventilation device, especially in the form of a fan, is to be provided. The installation space in the pole element 4 from FIGS. 1, 4 and 5 is selected such that a convective flow within the pole element 4 is produced by the introduction of heat of lamp 35, such that an automatic and forced, especially sufficient cooling of the lamp 35 takes place during the operation. Thus, it can be seen that a projection surface can be illuminated as desired starting from a light pole 1 with the projection device 6 according to the present invention.

A vertical, "standing" installation of the projection device 6 in the pole element 4 is shown in the drawing FIGS. 2 through 5 as well as 6 and 7. To be able to project, for example, various motifs also onto a projection surface lying markedly above the projection device 6, a "hanging" installation position may also be provided, in which the deflecting mirror 20 is arranged below, so that by means of the pivotable design of the deflecting mirror 20, a beaming or projection at an upper wall area or at the ceiling is also made possible.

Since the projection device 6 is designed as a complete structural unit in the present exemplary embodiment, such a reconstruction may also be carried out, if necessary, after the installation of a pole element in a multicomponent pole by simple "rotation" of the entire projection device 6 in the pole element 4. Consequently, variable use is made possible, especially in a reconstruction or change in the requirements on the direction of projection of the projection device 6.

It is likewise conceivable that the pole element 4 has a two-component design and is placed with its lower part, for example, onto the basic element 2. Then, for example, the intermediate element 8 having a really short design can be provided between this lower part of the pole element 4 and its upper part. In such an embodiment, the lower part of the pole element 4 may accommodate, for example, the lighting means in the form of lamp 35 together with the focusing device 17 and the motif carrier 18, while the upper part is equipped with the projection lens 19 or 56 and deflecting mirror 20. In a corresponding "hanging" arrangement of the projection device 6, top and bottom are correspondingly reversed. The deflecting mirror 20 may also be designed, for example, as an optical prism. This two-component mechanical structure especially makes possible comfortable adjustment with simultaneous compliance with safety-relevant requirements and supports the realization of longer maintenance intervals due to thermal optimization.

A projection device, in which the light source and projection lens, including the light control in the pole element and/or (with corresponding formation of a light pole) are arranged integrated directly in the light pole, is especially provided by the design according to the present invention. Thus, especially the external aesthetic molding of the pole element or the light pole is completely retained and is not "deformed" by jutting out elements.

By means of the additional possibility of the desired arrangement of the projection device (standing or hanging) with its adjustable deflecting mirror as well as the freely selective angle position about the longitudinal axis of the pole element or light pole, a desired direction of projection can be adjusted. If motor drives are provided for the adjustment of the deflecting mirror and/or a motorized adjustment of the angle position, then the direction of projection can also be adapted to changing optical shape desires after the installation of the projection device.

The projection device may also be designed—within certain limits—as rotatable within the pole element about its longitudinal axis. The maximum angle of rotation or angle of adjustment from one end position into a second end position depends on the "opening angle" of the light exit opening.

The device carrier 110, for example, may also be optionally equipped with a "color changer," as a result of which further optical effects can be achieved.

While specific embodiments of the invention have been shown and described in detail to illustrate the application of the principles of the invention, it will be understood that the invention may be embodied otherwise without departing from such principles.

The invention claimed is:

1. A street lamp comprising:

a tubular pole element;

a projection device having a light source built into the pole element, whose light rays can be projected onto an optical deflecting mirror by means of an optical focusing device in the pole element, by which the light rays can be deflected through a light exit opening of the pole element onto a remote projection;

a motif;

a motif carrier arranged in a ray path, of the light rays, between the light source and the deflecting mirror; and an adjustable projection lens arranged between the motif carrier and the deflecting mirror, by means of which at least a sharpness of the motif depicted on the remote projection surface can be adjusted.

2. A street lamp in accordance with claim 1, wherein:

the light source and focusing device together with the motif carrier form one unit; and the light source, focusing device and motif carrier are adjustable in relation to one another in a direction of the light rays.

3. A street lamp in accordance with claim 2, further comprising: a lamp socket;

a lamp socket holder; and a guide system, wherein:

the light source is accommodated replaceably in the lamp socket;

the lamp socket holder is plate shaped;

the lamp socket is mounted in an adjustable and fixable manner via the plate-shaped lamp socket holder along the guide system and;

the motif carrier has a plate-shaped design and is fastened in an adjustable and fixable manner to the guide system.

4. A street lamp in accordance with claim 1, wherein the focusing device comprises a rotationally symmetrical, ellipsoidal reflector, as a cold-light reflector, or as a beveled reflector, each of which has an elliptical geometry.

5. A street lamp in accordance with claim 4, further comprising a ring reflector, by means of which both the efficiency and brightness distribution of the light source can be optimized, provided between the ellipsoidal reflector and the motif carrier.

6. A street lamp in accordance with claim 1, wherein the focusing device comprises an adjustable spherical mirror arranged behind the light source and an adjustable twin condenser, with two nonspherical lenses, arranged in front of the light source.

7. A street lamp in accordance with claim 1 further comprising:

a carrier element; and a guide system, wherein:

the projection lens comprises a replaceable projection lens having a high image quality the deflecting mirror to form an optical unit; and the lens and deflecting mirror are each fastened in an adjustable manner via the carrier element to the guide system.

8. A street lamp in accordance with claim 1 further comprising:

a guide system, wherein:

the projection lens is formed from two planoconvex lenses, which are adjustable in relation to one another;

the planoconvex lenses are each fastened in an adjustable manner via a plate-shaped lens holder together with a carrier element of the deflecting mirror to the guide system;

or the projection lens consists of one or more adjustable biconvex lenses.

9. A street lamp in accordance with claim 1 further comprising a device carrier, which can be selectively and replaceable equipped with color filters and/or adjustable masking apertures, provided between the focusing device and the motif carrier.

10. A street lamp in accordance with claim l further comprising a mounting bracket wherein the deflecting mirror is accommodated in the mounting bracket which is pivotable about a mounting axis running transversely to the pole element.

11. A street lamp in accordance with claim l further comprising:

a guide system, wherein:

the light source, the optical deflecting mirror and the optical focusing device of the projection device form one unit and are connected via the guide system and are designed as being adjustable in relation to one another.

12. A street lamp in accordance with claim 11 further comprising servomotors associated with the light source, the optical deflecting mirror and the optical focusing device, wherein the light source, the optical deflecting mirror and the optical focusing device are displaceable and/or adjustable components of the projection device that are displaced and adjusted by means of the servomotors and the servomotors can be remote controlled.

13. A street lamp in accordance with claim l wherein:

the pole element accommodating the projection device comprises a separate component and can be selectively inserted into a split light pole or can be attached to the light pole; and the pole element is designed as adjustable over 360° about the longitudinal axis of the light pole in relation to the light pole with regard to the horizontal direction of beam of the projection device.

14. A street lamp in accordance with claim l wherein the pole element has a closable inspection opening on a side opposite the light exit opening.

15. A street lamp in accordance with claim l wherein the inside diameter of the pole element provides an annular clearance between the pole element and the projection device, so that a circumferential convective flow of air is brought about within the pole element during operation due to the development of heat of the light source.

* * * * *